United States Patent [19]

Motten, Jr.

[11] 4,097,114

[45] Jun. 27, 1978

[54] FUSE HOLDER WITH SEPARATE REJECT SPRING

[75] Inventor: Roger Henwood Motten, Jr., Bowling Green, Ohio

[73] Assignee: Marathon Electric Manufacturing Company, Wausau, Wis.

[21] Appl. No.: 791,795

[22] Filed: Apr. 28, 1977

[51] Int. Cl.[2] ..... H01H 85/24

[52] U.S. Cl. ..... 339/259 F; 337/226

[58] Field of Search ..... 339/186 R, 150 F, 219 F, 339/252 F, 253 F, 256 C, 258 F, 259 F, 262 F; 337/215, 225, 226

[56] References Cited

U.S. PATENT DOCUMENTS 2,011,391 8/1935 Bennett ..... 339/259 F

FOREIGN PATENT DOCUMENTS 1,043,480 11/1958 Germany ..... 337/215

*Primary Examiner*—Neil Abrams

*Attorney, Agent, or Firm*—Andrus, Sceales, Starke & Sawall

[57] ABSTRACT

A fuse holder with a reject spring which will only accept a ferrule type fuse with an annular groove in the ferrule at one end. The reject member is a reinforcing spring located externally of the fuse clip on the fuse holder with ears on each side extending through complementary openings in each side of the fuse clip to engage the groove in the fuse. Flanges extend outwardly of the reinforcing spring to engage the side walls of the molding or body of the fuse holder as the fuse passes through the upper restriction of the fuse clip to prevent displacement of the ears on the spring from inside the fuse clip.

1 Claim, 7 Drawing Figures

FUSE HOLDER WITH SEPARATE REJECT SPRING

BACKGROUND OF THE INVENTION

Previously fuse clips on fuse holders were constructed with reject means integral with the fuse clip involving a special construction of each clip where reject means was required. The present invention eliminates specially constructed fuse clips and instead a simplified separate reject construction is provided in the form of a reinforcing spring having abutments extending through a slot in each side wall of the fuse clip and means preventing displacement of the abutments from within the clip when a fuse is inserted in the clip.

SUMMARY OF THE INVENTION

The present invention is directed to a reject member which is a reinforcing spring separate from the fuse clip and located externally of the clip. Inwardly extending abutments or ears on the reinforcing spring extend through complementary openings in opposite sides of the clip to engage the annular groove in the ferrule of the fuse and outwardly extending abutments or ears at the upper end of the reinforcing spring engage the side walls of the body or base of the fuse holder as a fuse passes through the upper restriction of the fuse clip to prevent displacement of the ears from inside the clip. The construction in a more simplified manner prevents a clip with an ungrooved ferrule from entering the fuse clip so that only the proper fuse is accepted by the clip.

DESCRIPTION OF THE PREFERRED EMBODIMENT

The fuse holder of the invention is comprised of the body or base 1 with upstanding side walls 2 and has the fuse clips 3 secured thereto at each end.

Figure 1:
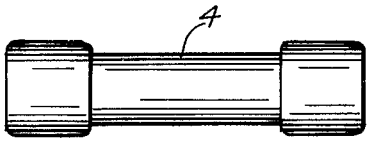
FIG. 1 is a side elevational view of a fuse with ungrooved ferrules at both ends.
Figure 2:
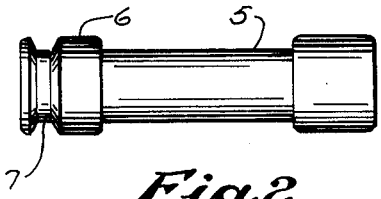
FIG. 2 is a side elevational view of a fuse with an annular groove in one of the ferrules.

FIG. 1 illustrates a fuse 4 with ungrooved or straightly extending ferrules and is the type of fuse which is desirable to be rejected from the fuse holder because it is not the proper fuse for the particular use for which the fuse holder is designed. FIG. 2 illustrates fuse 5 which is to be accepted by the fuse holder. Fuse 5 in the ferrule 6 at one end has an annular groove 7 which will be received by abutments assembled with one of the clips 3 which abutments will reject the ungrooved fuse clip 4.

Figure 5:
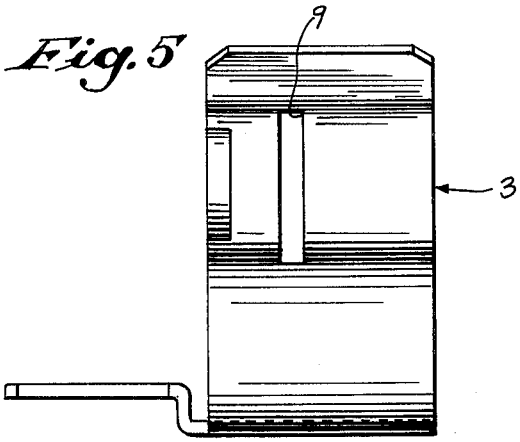
FIG. 5 is a side view of the fuse clip showing the opening on one side of the clip through which the ears of the reinforcing spring extend.
Figure 6:
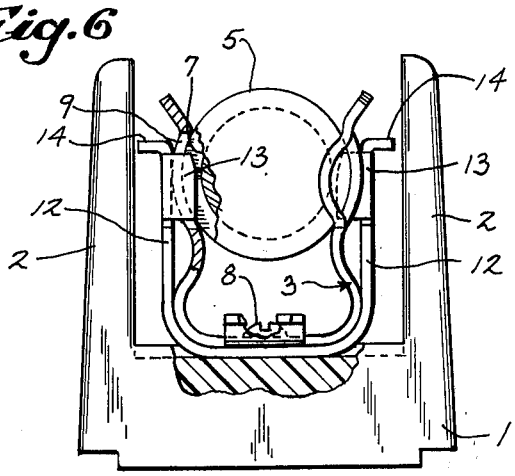
FIG. 6 is an end elevational view with parts broken away and sectioned of the fuse and reinforcing spring assembled with the clip.
Figure 7:
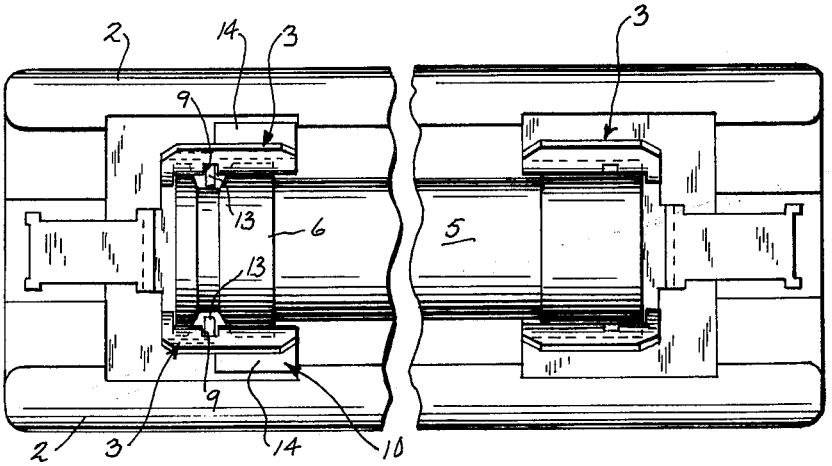
FIG. 7 is a top plan view illustrating the fuse and reinforcing spring assembled with the clip.

The fuse clip 3 as illustrated in FIG. 6, is a standard fuse clip which is secured to base 1 by screws 8 or the like and is flared outwardly at the upper end, as shown in FIGS. 6 and 7, to more readily insert a fuse in the clip such as fuse 5. Both sides of fuse clip 3 have a slot or opening 9 as shown in FIGS. 5 and 7.

Figure 3:
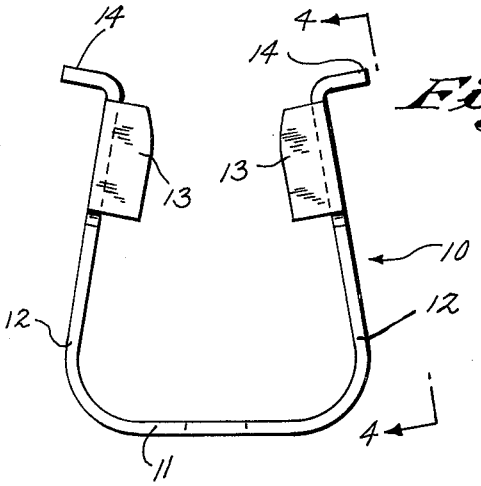
FIG. 3 is an end elevational view of the reinforcing spring of the invention.

The reinforcing spring 10 of the invention as particularly illustrated in FIG. 3 has a generally flat base 11 disposed between base 1 of the fuse holder and the bottom of clip 3, and spring 10 is secured to base 1 of the fuse holder by the same screws 8 or the like which attach clip 3 to base 1.

Spring 10 has generally straight sides 12 and in unassembled position as illustrated in FIG. 3, sides 12 in their upward extent are tensioned inwardly toward each other so that when assembled with clip 3 the spring 10 will securely grip clip 3.

Adjacent the upper end spring 10 is provided on each side with the inwardly extending abutments or ears 13 which have a width and length to be accepted within the slot or opening 9 of fuse clip 3. The inward tension of the spring 10 holds ears 13 securely inside clip 3 because the spring 10 is expanded when applied to clip 3 and thereby placed under greater tension. Spring 10 is completed at the upper end by the outwardly extending flanges 14 of a length to permit insertion of fuse 5 into the clip but serving to limit the outward movement of spring 10 as upon limited expansion of spring 10 flanges 14 engage walls 2 of the fuse holder as the fuse 5 upon assembly with clip 3 passes through the upper restriction of fuse clip 3. Flanges 14 therefore prevent outward displacement of ears 13 through the slot 9.

Figure 4:
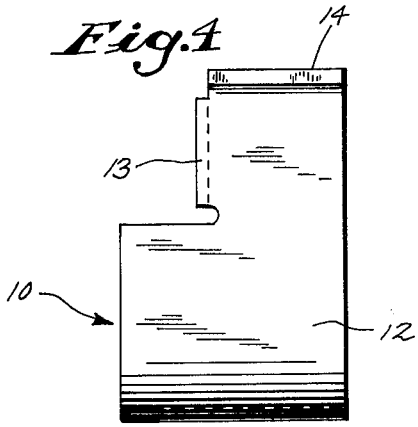
FIG. 4 is a view taken on line 4—4 of FIG. 3 and illustrating the outer side and the formation of the reinforcing spring.

FIG. 4 illustrates the side appearance of resilient spring 10 showing the shape of a side wall 12 and one of the flanges 14 at the upper end of spring 10 and the back of one ear 13.

In the assembly of the resilient spring 10 with clip 3, the spring is first assembled around clip 3 with the ears 13 extended through the slots 9 on both sides of clip 3. Clip 3 and spring 10 are then secured to base 1 of the fuse holder by screws 8 or the like. In service, fuse 5 is assembled with clip 3 by forcing it downwardly through the entrance of the clip and the ears 13 of spring 10 readily lodge within the annular groove 7. Upon insertion of fuse, spring 10 is forced slightly outwardly until the flanges 14 of spring 10 engage walls 2 of the fuse holder as the fuse 5 passes through the upwardly restricted portion of fuse clip 3 and thereby insures that the ears 13 will not be displaced from inside clip 3.

In the event that fuse 4 is attempted to be inserted within clip 3, the reinforcing spring 10 then operates to reject fuse 4 as the latter engages ears 13.

The construction of the invention provides a simplified reject device to insure that the correct fuse is inserted into the fuse holder.

Various modes of carrying out the invention are contemplated as being within the scope of the following claims particularly pointing out and distinctly claiming the subject matter which is regarded as the invention.

I claim:

1. A reject device for a fuse clip located in a fuse holder for use with ferrule type fuses having a grooved ferrule on one end of the fuse to insure that only ferrule type fuses are accepted in the holder, which comprises a separate reinforcing spring assembled around the fuse clip with the clip having slots therein in opposite sides of the walls of the clip and located below the upper ends of the clip, means securing the assembled clip and spring to the base of the fuse holder, inwardly turned horizontally aligned abutments provided adjacent the upper end of the reinforcing spring and of a construction complementary to a groove in a ferrule type fuse which upon assembly with the fuse clip extend inwardly of the clip through the respective slots to dispose the abutments inside the clip and thereby lodge the abutments in the annular groove of a ferrule type fuse when the latter is inserted in the clip, and flange means at the upper ends of the reinforcing spring extending horizontally outwardly therefrom to engage the walls of the holder upon spreading of the fuse clip when a ferrule type fuse is inserted and limit displacement of the abutments inside of the clip to thereby provide for acceptance of only a ferrule type fuse.

* * * * *